US007942756B1

(12) United States Patent
Neu

(10) Patent No.: US 7,942,756 B1
(45) Date of Patent: May 17, 2011

(54) GOLF TOOL WITH INSERT

(76) Inventor: Kenneth Neu, Fort Myers, FL (US)

( * ) Notice: Subject to any disclaimer, the term of this patent is extended or adjusted under 35 U.S.C. 154(b) by 0 days.

(21) Appl. No.: 12/927,387

(22) Filed: Nov. 12, 2010

Related U.S. Application Data

(63) Continuation-in-part of application No. 12/592,394, filed on Nov. 23, 2009, which is a continuation-in-part of application No. 12/157,693, filed on Jun. 12, 2008, now Pat. No. 7,621,819, which is a continuation-in-part of application No. 11/825,810, filed on Jul. 9, 2007, now Pat. No. 7,527,563.

(51) Int. Cl.
*A63B 57/00* (2006.01)

(52) U.S. Cl. ..... 473/282; 473/286; 81/460; 248/156; 172/375; 172/378

(58) Field of Classification Search ..... 473/282–286, 473/408; D21/793, 796; 81/460; 248/156, 248/530; 172/378, 375
See application file for complete search history.

(56) References Cited

U.S. PATENT DOCUMENTS 4,535,987 A * 8/1985 Dikoff ..... 473/406
D290,985 S * 7/1987 Dikoff ..... D21/793
4,908,899 A * 3/1990 Killen ..... 15/105
5,217,477 A * 6/1993 Lager ..... 606/167
5,226,647 A * 7/1993 Notarmuzi ..... 473/284
5,261,299 A * 11/1993 Kondos ..... 81/3.09
5,401,019 A * 3/1995 Wissman et al. ..... 473/286
5,419,551 A * 5/1995 Hoyt et al. ..... 473/406
5,643,113 A * 7/1997 Rodgers ..... 473/386
6,004,229 A * 12/1999 Fazekas ..... 473/406
6,290,617 B1 * 9/2001 Cole et al. ..... 473/408
6,514,159 B2 * 2/2003 Hendren ..... 473/408
6,565,458 B1 * 5/2003 Cameron ..... 473/408
6,668,460 B2 * 12/2003 Feng ..... 30/161
6,688,505 B1 * 2/2004 Bradley et al. ..... 224/230
7,343,835 B2 * 3/2008 Jensen ..... 81/3.27

* cited by examiner

*Primary Examiner* — Stephen L. Blau

(57) ABSTRACT

A golf tool capable of performing multiple manipulation tasks associated with the play of the game of golf has a body of a first material and inserts of a second material. The inserts are user removable and replaceable relative to the body of the golf tool. The inserts will be associated with tasks which require a relatively strong and durable material in order to ensure an acceptable life span for performance of their respective tasks. Cutting or scrapping operations are such tasks. The use of durable inserts provide for the body of the golf tool to be considerable less expensive to manufacture using lighter and softer materials than that material utilized for the inserts. Replacement of the insert with a replacement insert, supplied with the golf tool, is an option when the respective deployed insert becomes worn or dull. Removal of certain inserts provide for easier sharpening of cutting edges.

15 Claims, 8 Drawing Sheets

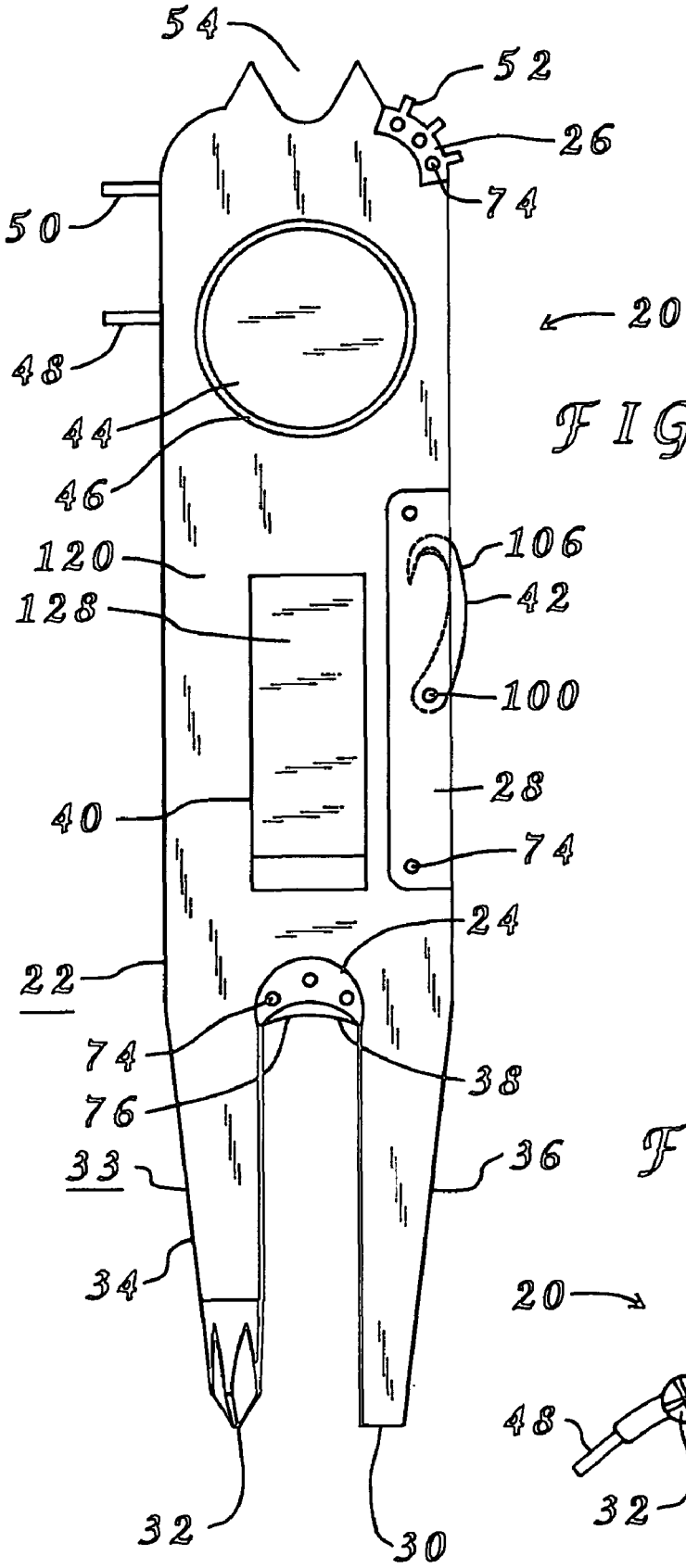
FIG. 1a
FIG. 1b
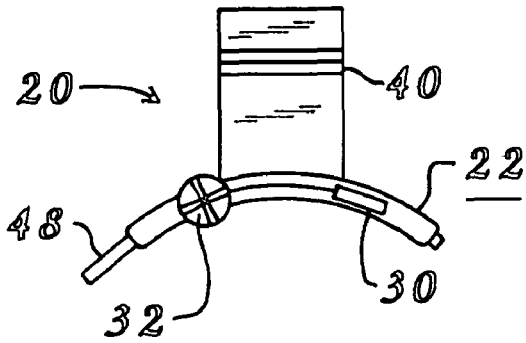

FIG. 2
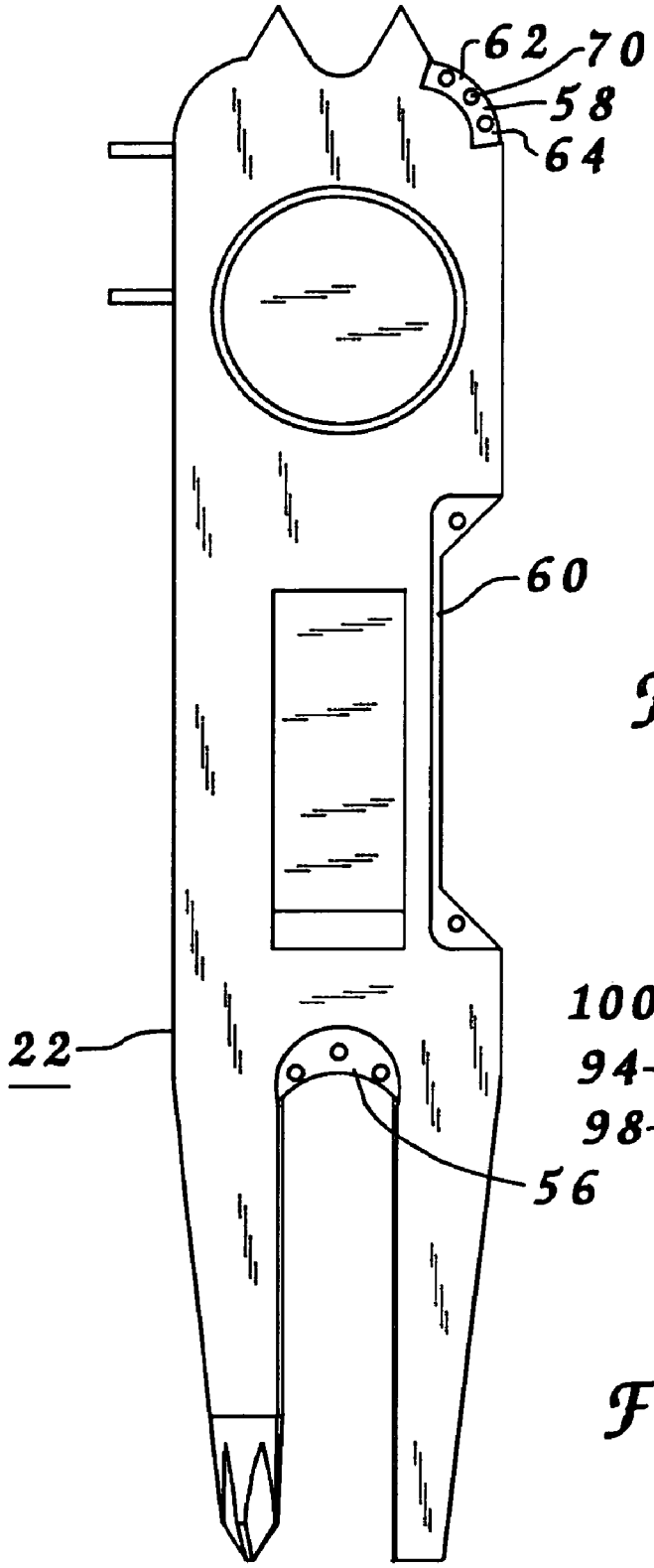
FIG. 4a
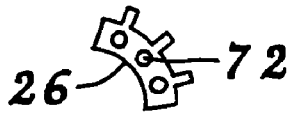
FIG. 4b
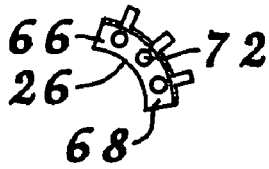
FIG. 5a
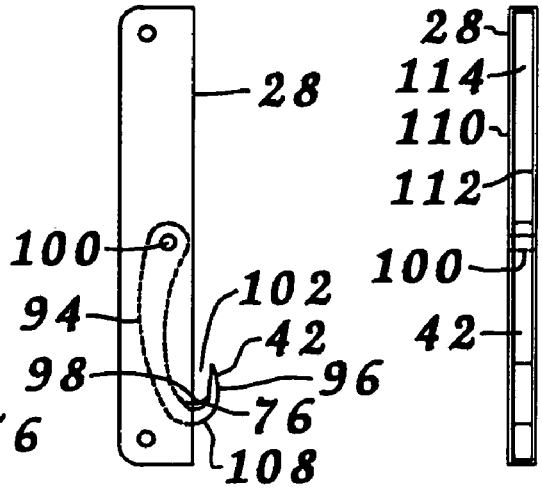
FIG. 5b
FIG. 3
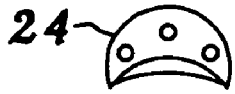

FIG. 11
'Prior Art'
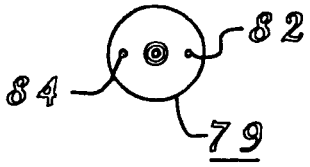
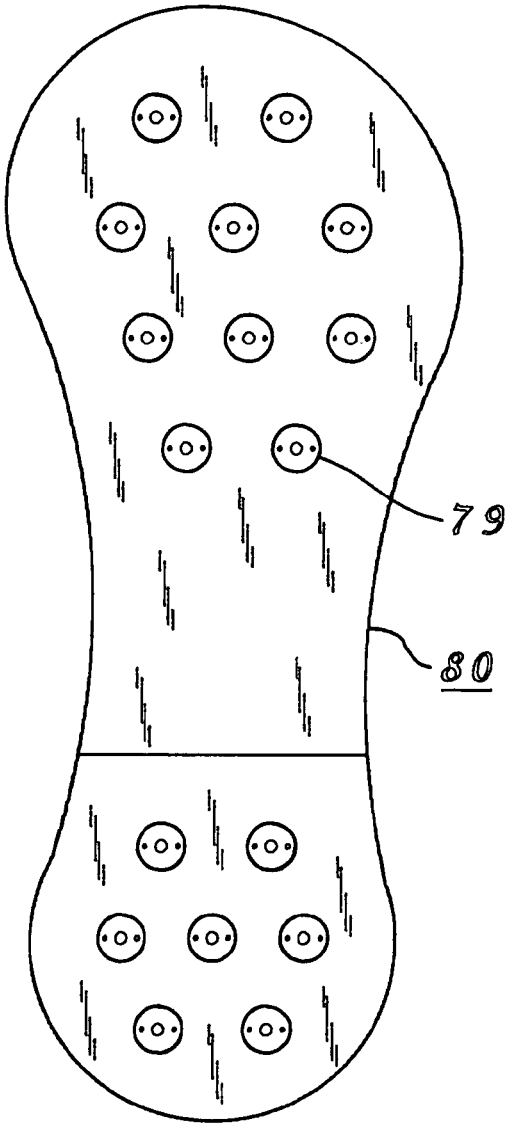
FIG. 10
'Prior Art'
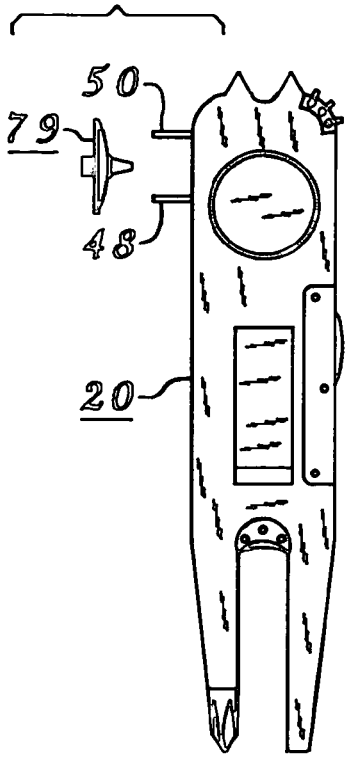
FIG. 12a
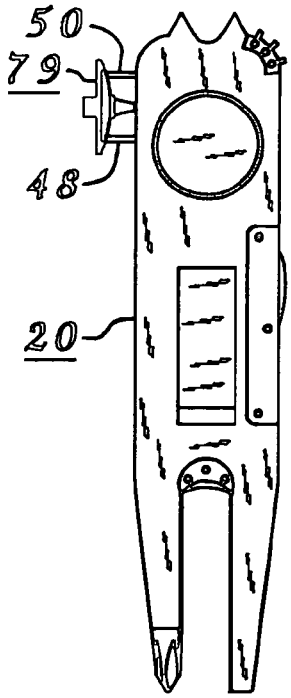
FIG. 12b

GOLF TOOL WITH INSERT

CROSS REFERENCE

This application is a continuation in part of Ser. No. 12/592,394 filed Nov. 23, 2009, currently pending, which was a continuation in part of U.S. Pat. No. 7,621,819, Ser. No. 12/157,693, filed Jun. 12, 2008 which was a continuation in part of U.S. Pat. No. 7,527,563, Ser. No. 11/825,810, filed Jul. 9, 2007. The original applications are incorporated herein by this reference.

BACKGROUND

1. Field of the Invention

Generally, the invention relates to tools utilized during the playing of golf. More specifically, the invention relates to tools having multiple purposes and having at least one insert portion of a different material than that material of a body of the tool.

2. Description of the Prior Art

The game of golf is enjoyed by many persons. Such players range from beginner players to occasional recreational players to serious recreational players to serious amateur players to professional players. Many regular non professional players, including retired or semi retired persons, routinely enjoy the game of golf on a very regular basis. It is common to have players of golf living in communities which have at least one golf course owned and operated by the community. Such players often enjoy a round of golf on a very regular schedule, including daily.

Numerous tools, including divot tools, exist to assist golfers during the play of the game of golf. Golfers typically utilize a collection of golf clubs during play which include woods, irons and a putter. Normally such clubs are retained in a golf bag during storage, transport to and from the playing areas of golf courses, and during movement about the golf course during play. Numerous designs of golf bags exist in the art with areas for placement of the golf clubs and various other objects associated with the play of golf, such other objects including various tools utilized during the play of the game of golf. Various of these tools are occasionally carried about on the person of the player, either in a pocket of clothing or otherwise attached to clothing, such as in belt clips.

All golf courses employ persons to tend to and care for their golf course including providing for the care and maintenance of the vegetation associated with the course. This includes watering and mowing of the grass of the fairways and greens and the grass about the fairways and greens. The greens are particularly important to both the personnel of the golf course and to the players. Each player, at each of the holes of a golf course, move their ball from the tee along a fairway to the green and eventually into the cup. During such play a lofted shot will often land on the green where the impact of the ball, depending upon the distance stuck and the height obtained, will compress the well manicured grass of the green, and the soil underneath, at the point of impact. This point of impact, beyond being an impediment to subsequent players putting across this point to reach the cup, will actually damage the green if the compression is not relieved relatively quickly. It is known to have at least some of the grass at such untended impact points actually die. Experienced and considerate players of golf take great care to ensure that they do not damage the golf course, including the greens. Therefore, most players carry and routinely use a divot tool to manually release the compacting pressure caused by divots created by their respective play. Most serious players, when they notice a divot on a green which they, or their party, did not cause will routinely tend to the noted divot and release the compacting pressure of the divot.

It is known to provide tools have various capabilities. Tools are known in the art to provide for performance of each of these useful functions, divot repair, club support, club face groove cleaning, golf shoe spike cleaning, golf shoe spike installation and removal, rotationally manipulating a phillips head screw, rotationally manipulating a slotted head screw, removing a bottle cap from a bottle, sharpening a pencil and lifting a pull tab from a beverage can.

Various of the above mentioned useful functions are occasionally desired to be performed during the play of the game of golf. Few players would even consider taking along individual tools to perform all of these useful functions. Some multi purpose tools are known in the art having numerous functional capabilities. An excellent example is the multi purpose tool where pivotal manipulation from a housing transfers portions between a stored orientation and a deployed orientation. While very versatile, these tools are awkward to manipulate to bring the desired portion having the desired feature into the deployed orientation. Additionally, following performance of the desired useful function the deployed portion must then be returned to the respective stored orientation. All of this is time consuming and may even result in injury to the user, such as damage to fingernails used during initial transfer of the portion from the stored orientation to the deployed orientation. A far better solution resides in placing structures to perform all of the desired useful functions on a single tool without any moving parts which must be manipulated.

It is known in the art to provide tools having a base portion formed of a first material and active portion formed of a second, more durable material, attached to the base portion by various means. An excellent example is a cutter, such as a letter opener, having a plastic handle with a metallic blade positioned thereon during the manufacturing process. Such use radically reduces the expense of manufacture when compared to an identical object completely formed of the metallic material. Numerous other benefits exist for such dual material articles, including being light weight and easier to handle and transport. It is known in the art to provide for user removeable and user replaceable parts formed of unique materials.

Conventionally known multiple function golf tools formed of a single material have the problem of either being strong enough to withstand use but are excessively expensive or are economically available but are to weak structurally to withstand use.

Various deficiencies exist with each of the known methods of providing tools capable of performing desired useful functions during the play of the game of golf. As can be seen various attempts have been made to provide a player with tools for use during play of the game of golf which are strong and durable yet reasonable priced. These attempts have been less efficient than desired. As such, it may be appreciated that there continues to be a need for a multiple purpose tool capable of being readily carried about by the player and which has structural integrity at key operational points and which is capable of performing any of the desired useful functions. The present invention substantially fulfills these needs.

SUMMARY

In view of the foregoing disadvantages inherent in the known tools utilized by golfers, your applicant has devised a multiple purpose golf tool which has inserts which are strong and durable while providing the player with various desired useful functions. A multiple purpose golf tool provides for performance of multiple useful functions during play of the game of golf. The multiple purpose golf tool has a body portion and an insert portion. The body portion has features to perform at least a first useful function during play of the game of golf. The body portion is formed from a first material and has a turf repair portion to perform the first useful function associated with the play of the game of golf being release of compression of turf associated with an impact from a golf ball. The turf repair portion is inserted into the turf at a point of insertion and then manual manipulation of the multiple purpose golf tool to displace the turf repair portion while inserted in the turf to release the compression of the turf about the point of insertion of the turf repair portion. The turf repair portion has a first extension and a second extension. The insert portion is attachable to the body portion and is formed from a second material. The insert portion performs a second useful function during play of the game of golf.

My invention resides not in any one of these features per se, but rather in the particular combinations of them herein disclosed and it is distinguished from the prior art in these particular combinations of these structures for the useful functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide for players of golf to have ready and convenient access to an easy to use multiple purpose golf tool having at least the ability to perform turf repair on divots on greens and the ability to perform at least one (1) other useful function.

Other objects include;

a) to provide for the multiple purpose golf tool to be small and compact and formed of a body portion and at least one insert portion which is attachable to the body portion.

b) to provide for the body portion to be formed of a first material and the insert portion, or portions, to be formed of a second material where the insert portions can be strong and durable.

c) to provide for the insert portions to be easily removed and installed by the user.

d) to provide for a multiple purpose golf tool having a divot repair tool incorporated thereon.

e) to provide for the multiple purpose golf tool to optionally have a club support tool incorporated thereon.

f) to provide for the multiple purpose golf tool to optionally have a club face groove cleaner tool incorporated thereon.

g) to provide for the multiple purpose golf tool to optionally have a golf shoe spike cleaner tool incorporated thereon.

h) to provide for the multiple purpose golf tool to optionally have a golf shoe spike install/removal tool incorporated thereon.

i) to provide for the multiple purpose golf tool to optionally have a phillips head screwdriver tool incorporated thereon.

j) to provide for the multiple purpose golf tool to optionally have a slotted head screwdriver tool incorporated thereon.

k) to provide for the multiple purpose golf tool to optionally have a bottle opener tool incorporated thereon.

l) to provide for the multiple purpose golf tool to optionally have a pencil sharpener tool incorporated thereon.

m) to provide for the multiple purpose golf tool to optionally have a beverage can pull tab lifter tool incorporated thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein;

FIG. 1*a* is a front elevational view of a multiple purpose golf tool.

FIG. 1*b* is a bottom plan view of the multiple purpose golf tool.

FIG. 2 is a front elevational view of a body portion of the multiple purpose golf tool.

FIG. 3 is a front elevational view of an insert portion.

FIG. 4*a* and FIG. 4*b* are elevational views of an insert portion showing opposing sides of the insert portion.

FIG. 5*a* and FIG. 5*b* are elevational views of an insert portion showing a front side and an edge side.

FIG. 10 is a plan view of the bottom of a golf shoe and labeled as 'Prior Art'.

FIG. 11 is a plan view of the bottom of a spike member as used on the golf shoe depicted in FIG. 10 and labeled as 'Prior Art'.

FIG. 12*a* and FIG. 12*b* are front elevational views of the multiple purpose golf tool and the spike member shown in FIG. 11 as would occur during a spike member adjustment procedure.

DESCRIPTION

Figure 1C:
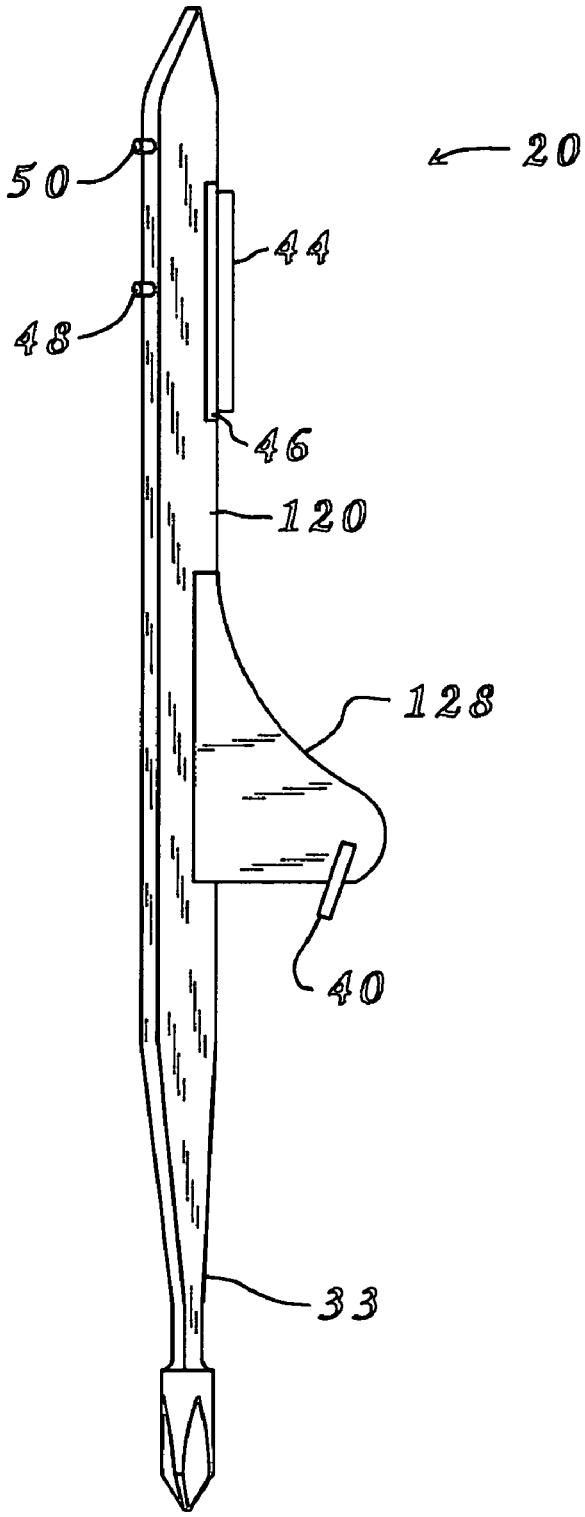
FIG. 1*c* is a side elevational view of the multiple purpose golf tool.

Many different devices having features of the present invention are possible. The following description describes the preferred embodiment of select features of those devices and various combinations thereof. These features may be deployed in various combinations to arrive at various desired working configurations of devices.

Reference is hereafter made to the drawings where like reference numerals refer to like parts throughout the various views.

Structural configurations will be provided on a multiple purpose golf tool, having features of the present invention, to perform respective useful functions associated with the play of the game of golf.

Preferably each multiple purpose golf tool of the present invention will have structural elements to permit repair of divots on the greens where an impact of a golf ball from a lofted shot compresses the soil and the root system of grass in the soil of the turf. Conventional divot tool often have two tines extending from a gripping portion where the user slides the tines into the turf and gently manipulates the tool to lift the root system of the effected grass to release the pressure.

Examples of golf equipment which may have a cleaning operation performed thereon include the face, including trenches or other patterns, of heads of golf clubs which may gather soil and other debris thereon, and the soles of golf shoes, including about spikes positioned thereon. When a lateral curvature is provided on the multiple purpose golf tool the area of the multiple purpose golf tool about the protrusions may be flattened where the tips of each respective set of protrusions are linearly aligned along their entire length for performance of convenient cleaning operations.

When a Phillips head screw driving configuration is provided it is possible to plane of the opposing side extending outward relative to the outer surface and the inner surface of the multiple purpose golf tool to reduce the profile of the multiple purpose golf tool while retaining the useful function of the Phillips head screw driving configuration.

When a slotted head screw driving configuration is provided on one tine and a Phillips head screw driving configuration is provided on the opposing tine it is possible to angularly offset these configurations one to the other to provide more clearance to reach the respective fasteners during usage.

Beverage cans have evolved where most such cans currently have a flip type tab which when pivoted upward causes another tab portion to be pushed downward into the can to provide an opening in the can for the contents to pass through. Many designs for the flip type tab have been proposed and are currently in commercial usage. Typically such flip type tabs reside quite close to the top of the can prior to being utilized to open the can. It has been observed that many users have a difficult time with initial displacement of such flip type tabs away from their very close orientation with the top of the can. Often users will attempt to utilize a fingernail to perform the initial displacement operation. It has been known to have damage occur to the fingernail during such operations.

It is known to utilize a structural element, with various prior art references specifically directed toward this single useful function, to perform at least the initial tab displacement operation. Referring now to the present invention one of the tines, most likely the one with the slotted head screw driving configuration thereon, may be utilized to perform this initial displacement operation on flip type tabs on beverage cans. Alternatively, one of the series of protrusions on the lateral edges may be utilized to perform this initial displacement operation on flip type tabs on beverage cans. Alternatively, one, or both, of the pins of the spike member manipulation configuration may be utilized to perform this initial displacement operation on flip type tabs on beverage cans.

The multiple purpose golf tool may have features to permit use as a golf club support tool. This is provides for by partially inserted the multiple purpose golf tool into the ground with a golf club contact portion extending above the ground and any manicured grass growing thereon. The golf club contact portion may then have a portion of the golf club positioned thereon while a distal portion of the golf club contacts the ground. The portion of the golf club making contact with the golf club contact portion of the multiple purpose golf tool preferably will be part of the grip of the golf club while the portion of the golf club making contact with the ground will be the head of the golf club. This arrangement provides for the grip to be kept clean and dry. Many configurations may be deployed on the multiple purpose golf tool to permit a secure gravity biased retention of the grip of the golf club on the multiple purpose golf tool.

A multiple purpose golf tool provides for performance of multiple useful functions during play of the game of golf. Such useful functions include those which are undertaken during the actual play of golf, such as divot repair, club support, golf club head face groove cleaning, sharpening of a pencil, adjustment of screw tension on equipment, bottle cap opening and performance of other tasks. Such useful functions also include those which are undertaken on equipment associated with the play of golf when not actually engaged in the play of golf, such as grip removal, adjustment of screw tension on equipment and performance of other tasks. The multiple purpose golf tool will have a body portion formed of a first material and at least one insert portion formed of a second material with means to attach the insert portion to the body portion.

Multiple purpose golf tools having features of the present invention can have numerous sizes, shapes and proportions. The embodiment depicted has a curvature but a flat design is possible as is a curvature along the longitudinal length.

FIG. 1*a* through FIG. 1*c* specifically depict multiple purpose golf tool 20 formed of a body portion 22 and insert portions 24, 26 and 28. Multiple purpose golf tool 20 structural configurations to perform various useful tasks. Multiple purpose golf tool 20 has a slotted head screw driver bit 30, a phillips head screw driver bit 32, turf repair portion 33 formed of extensions 34 and 36, a cutting edge 38, a bottle opener 40, a grip remover 42, a ball marker 44 and a ball marker retention magnet 46, spike adjustment pins 48 and 50, a golf club groove cleaner assembly 52 and a club rest 54.

The body portion will be formed of a first material which is different than the material of the insert portion. The body portion will have features, in the form of its structural configuration, to perform at least a first useful function during play of the game of golf. Preferably the body portion will have a turf repair portion to provide for release of compression of turf associated with an impact from a golf ball. The turf repair portion provides for insertion into the turf at a point of insertion and then manual manipulation of the multiple purpose golf tool to displace the turf repair portion while inserted in the turf to release the compression of the turf about the point of insertion of the turf repair portion. Preferably the turf repair portion will have a first extension and a second extension which are positioned generally adjacent each other. In certain embodiments the body portion will have features, in the form of its structural configuration, to perform at least a second useful function during play of the game of golf.

FIG. 2 depicts body portion 22 having insert portion placement locations 56, 58 and 60. FIG. 3 depicts insert portion 24. FIG. 4*a* and FIG. 4*b* depict insert portion 26. FIG. 5*a* and FIG. 5*b* depict insert portion 28. Insert portion placement location 56 receives insert portion 24, insert portion placement location 58 receives insert portion 26 and insert portion placement location 60 receives insert portion 60.

Numerous methods are known in the art to secure two components together and many of these methods may be utilized with the present invention. Most preferably the insert portion may be released from the body portion by the user and reattached to the body portion by the user. This permits easy replacement of worn or damaged parts while making maintenance easier, such as sharpening of an edge on the insert portion without concern for damage being inflicted upon the body portion. Insert portion placement location 58 and insert portion 26 are depicted as an example of a preferred embodiment of coupling an insert portion to body portion 22. Body portion 22 has a seating surface 62 positioned on a recessed lip 64 about insert portion placement location 58, see FIG. 2.

Referring now generally to FIG. 2, FIG. 4*a* and FIG. 4*b*, insert portion 26 has a seating surface 66 positioned on a recessed lip 68 which contacts seating surface 62 on body portion 22 when installed thereon. Seating surface 62 of body portion 22 has a series of apertures 70. Seating surface 66 of insert portion 26 has a series of apertures 72 which align with apertures 70 when insert portion 26 is properly positioned relative to body portion 22. Threaded screws 74 are utilized within apertures 70 and 72 to secure insert portion 26 relative to body portion 22. Utilization of seating surface 62 and seating surface 66 permit smooth continuation of surface features on both sides of multiple purpose golf tool 20 while providing for a strong and durable coupling therebetween. One of the apertures 70 or 72 preferably will be at least partially threaded to provide for securement of threaded screw 74 therein. If desired one of the apertures 70 or 72 may only partially penetrate the respective portion. While recessed lip 64 and recessed lip 68 are depicted as being generally equal thickness it is possible to provide for the weaker material to have a disproportional thickness to enhance structural integrity.

Referring now generally to FIG. 1*a* and FIG. 1*b*, body portion 22 preferably has a structural configuration to perform a unique useful function associated with the play of the game of golf and positioned at a distal end of first extension 34 of turf repair portion 33 in the form of slotted head screw driver bit 30. Slotted head screw driver bit 30 is useful for applying a rotational pressure to a slot of a slotted head screw. If desired slotted head screw driver bit 30 may be part of an insert portion attachable to body portion 22.

Referring now generally to FIG. 1*a* through FIG. 1*c*, body portion 22 preferably has a structural configuration to perform a unique useful function associated with the play of the game of golf and positioned at a distal end of second extension 36 of turf repair portion 33 in the form of phillips head screw driver bit 32. Phillips head screw driver bit 32 is useful for applying a rotational pressure to a phillips head slot of a phillips head screw. If desired phillips head screw driver bit 32 may be part of an insert portion attachable to body portion 22.

Each deployed insert portion preferably will be formed from a second material relative to the material utilized to form the body portion. Preferably the insert portion will be formed of the stronger and more durable material to prolong the useful life of the multiple purpose golf tool.

Each insert portion is attachable to the body portion and permits the multiple purpose golf tool to perform a unique useful function during play of the game of golf.

Any of the structural configurations of the multiple purpose golf tool which act with other equipment can be deployed on, or as a part of, an insert portion and attached to the body portion. This includes the turf repair portion having a first extension and a second extension or merely the ends of the first and second extensions.

An insert portion may be constructed to provide for performance of a single class of function. Alternatively, insert portions can be formed to have readily identifiable areas which perform unique functions. One example of this embodiment involves a single piece insert in a horseshoe shape and having screw driver bits on the ends of extensions which form the turf repair portion. In this example the single insert has tools positioned thereon to perform three separate and distinct functions during the play of the game of golf.

Figure 9:
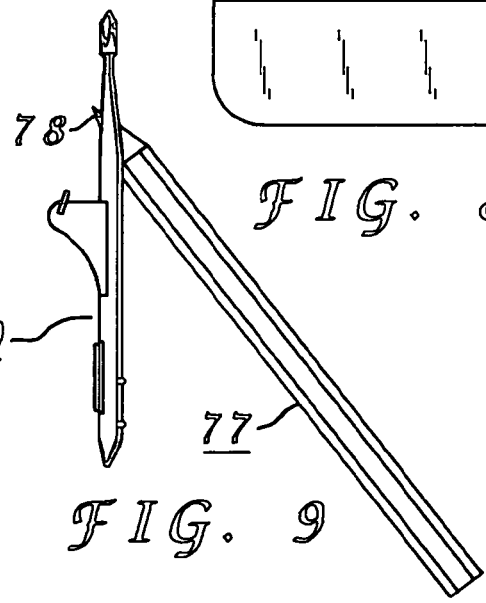
FIG. 9 is a side elevational view of the multiple purpose golf tool performing a pencil sharpening procedure.

Referring now generally to FIG. 1*a* and FIG. 9, the useful function performed by insert portion 24 comprises a structural configuration having a sharp edge 76 capable of performing a cutting procedure or sharpening procedure. Insert portion 24 is positioned between first extension 34 and second extension 36 of turf repair portion 33 of body portion 22. The useful function of insert portion 24 is ideally suited to sharpening pencils during play of the game of golf. One example of such a useful cutting purpose involves sharpening a pencil 77 during the play of the game of golf. Due to the spacing extensions 34 and 36 pencil 77 may be easily inserted therebetween and drawn downward along sharp edge 76 to remove material from pencil 77 until a point 78 is to a desired configuration on pencil 77.

Referring now generally to FIG. 1*a*, FIG. 10, FIG. 11, FIG. 12*a* and FIG. 12*b*, spike adjustment pin 48 and spike adjustment pin 50 cooperate to permit adjustment of, removal of and installation of, a spike 79 on a golf shoe 80. Pins 48 and 50 preferably will be of a stronger material than that utilized for body portion 22 and may be on a separate insert portion or my be directly installed into body portion 22 to extend therefrom. Spike adjustment pins 48 and 50 act upon opposing apertures 82 and 84 on spike 79 on golf shoe 80 to perform a spike manipulation procedure on spike 79 of golf shoe 80. It being understood that spike 79 and golf shoe 80 are workpieces and form no part of the present invention.

Figure 15:
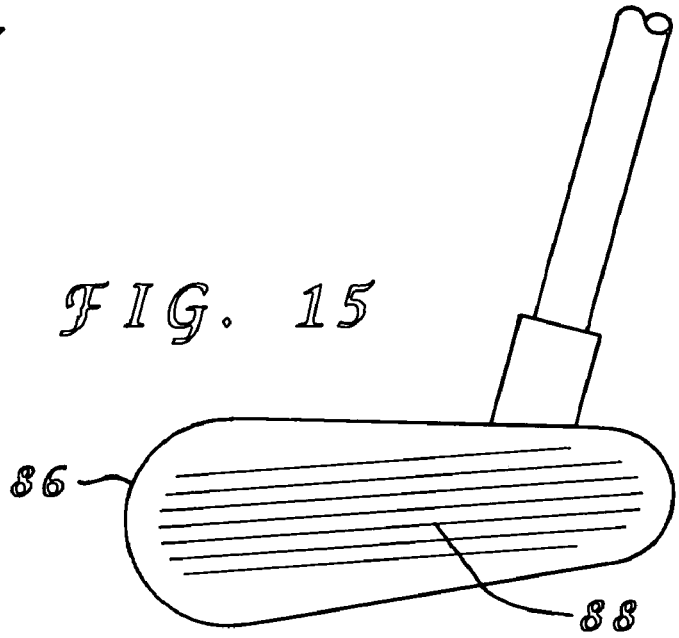
FIG. 15 is a front elevational view of a face of a golf club.

Referring now generally to FIG. 1*a* and FIG. 15, the useful function performed by insert portion 26 comprises a structural configuration having golf club groove cleaner assembly 52 capable of performing a clearing and cleaning procedure on a golf club head 86 having grooves 88 positioned thereon. It being understood that golf club head 86 and grooves 88 are workpieces and form no part of the present invention.

Referring now generally to FIG. 1*a*, FIG. 5*a*, FIG. 5*b* and FIG. 6, the useful function performed by insert portion 28 comprises a structural configuration having grip remover 42 capable of performing a cutting action of a grip wrapping material 90 of a golf club 92. Insert portion 28 has a pocket portion 94, an insertion portion 96, a cutting edge 98 and a pivot pin 100. Cutting edge 98 preferably is positioned adjacent insertion portion 96 at the end of a passageway 102. Insertion portion 96 slides between grip wrapping material 90 and a handle 104 of golf club 92 where cutting edge 98 makes contact with grip wrapping material 90 during the sliding action to severe grip wrapping material 90. Pivot pin 100 provides for insertion portion 96 to be displaced between a stored orientation 106, see FIG. 1*a*, and a usage orientation 108, see FIG. 5*a*. Preferably pocket portion 94 has opposing protecting walls 110 and 112 with a pocket 114 therebetween. This arrangement provides for protection of cutting edge 98 when in stored orientation 106. It being understood that grip wrapping material 90 is a workpiece and forms no part of the present invention.

Figure 6:
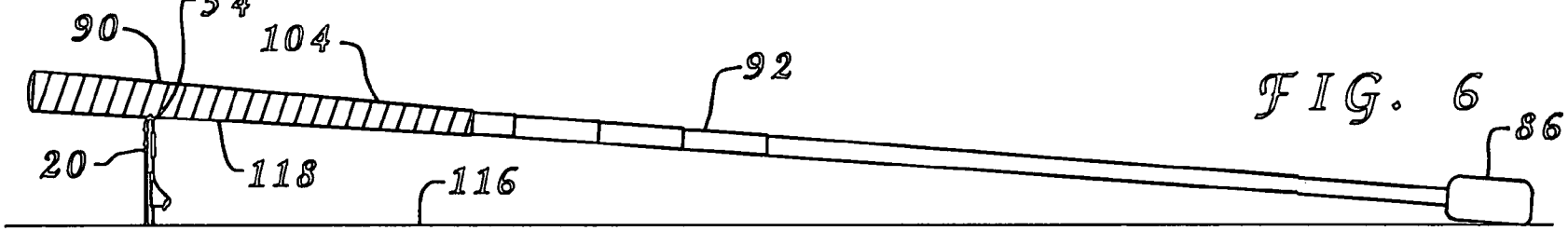
FIG. 6 is a side elevational view of the multiple purpose golf tool partially supporting the golf club above the turf of a golf course.

FIG. 6 depicts multiple purpose golf tool 20 partially inserted in turf 116 and functioning as a golf club support tool where club rest 54 contacts and supports grip 118 of golf club 92 above turf 116 while golf club head 86 of golf club 92 rests on turf 116. This provides for grip wrapping material 90 of handle 104 to be elevated above turf 116.

Referring now generally to FIG. 1*a* through FIG. 1*c*, FIG. 8*a* and FIG. 8*b*, an outer surface 120 of body portion 22 has positioned thereon a bottle opener 40. Bottle opener 40 is configured for engagement of a bottle cap 122 to apply a pivotal pressure to a lip 124 of bottle cap 122 to remove bottle cap 122 from a bottle 126. Bottle opener 40 further preferably has a sloped surface 128 extending smoothly from outer surface 120 of body portion 22. Sloped surface 128 makes an ideal thumb positioning location for the user during performance of many operations with multiple purpose golf tool 20, including during divot repair operations. It being understood that bottle 126 and bottle cap 122 are workpieces and form no part of the present invention.

Referring now generally to FIG. 1*a* and FIG. 1*c*, multiple purpose golf tool 20 preferably will have a ball marker 44 releasably attached thereto utilizing a ball marker retention magnet 46 for frequent usage to mark a ball location on a green. Ball marker retention magnet 46 may be positioned on an insert portion attachable to body portion or may be attached to body portion utilizing any applicable securement method known in the art.

Figure 16:
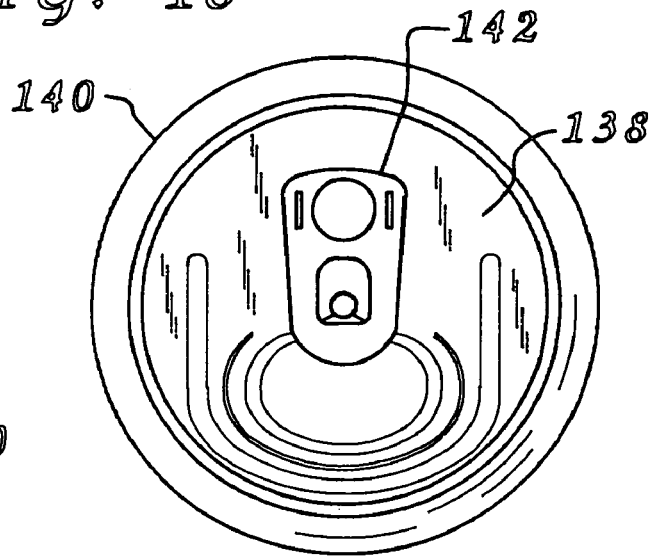
FIG. 16 is a top plan view of a top of a beverage can with a pull tab.
Figure 13:
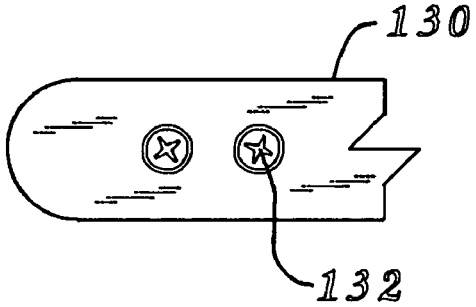
FIG. 13 is a plan view of a piece of golf equipment having a Phillip head screw.
Figure 14:
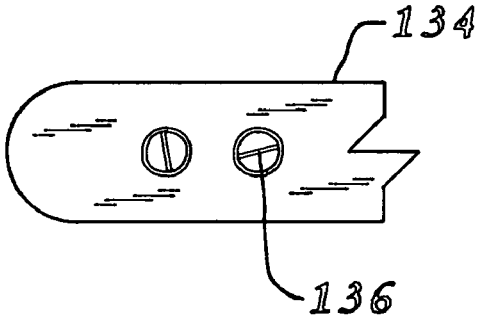
FIG. 14 is a plan view of a piece of golf equipment having a slotted head screw.

FIG. 13 depicts a piece of golf equipment 130 having a Phillips head screw 132 upon which phillips head screw driver bit 32 may operate. FIG. 14 depicts a piece of golf equipment 134 having a slotted head screw 136 upon which slotted head screw driver bit 30 may operate. FIG. 16 depicts a lid 138 of a beverage can 140 having a pull tab 142. End of extension 34 may be used to pry pull tab 142 away from lid 138 during an opening procedure of beverage can 140. It being understood that piece of golf equipment 130, phillips head screw 132, piece of golf equipment 134, slotted head screw 136, lid 138, beverage can 140 and pull tab 142 are workpieces and form no part of the present invention.

Figure 7A:
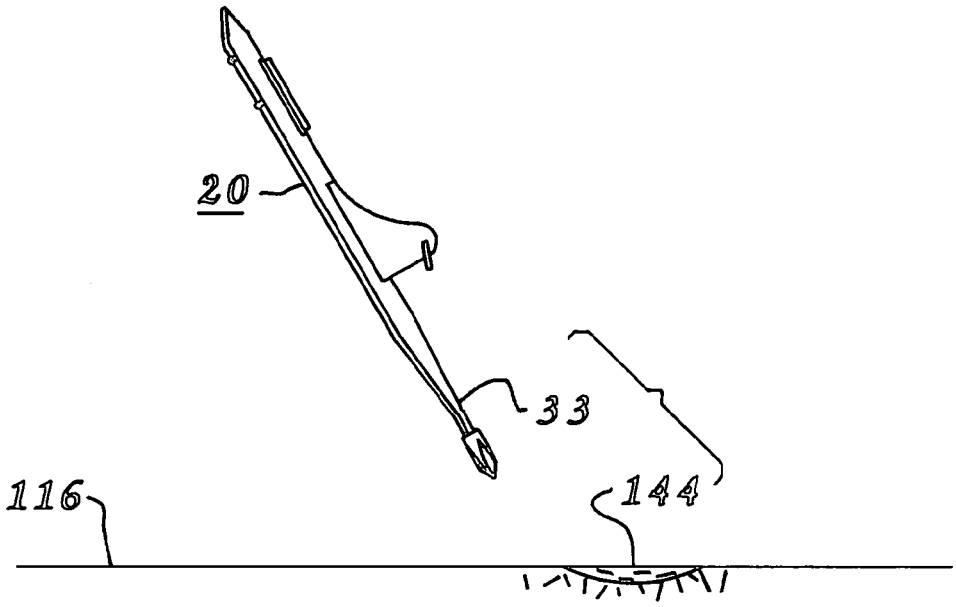
FIG. 7*a* through FIG. 7*c* are side elevational views of the multiple purpose golf tool performing a divot repair procedure.
Figure 7B:
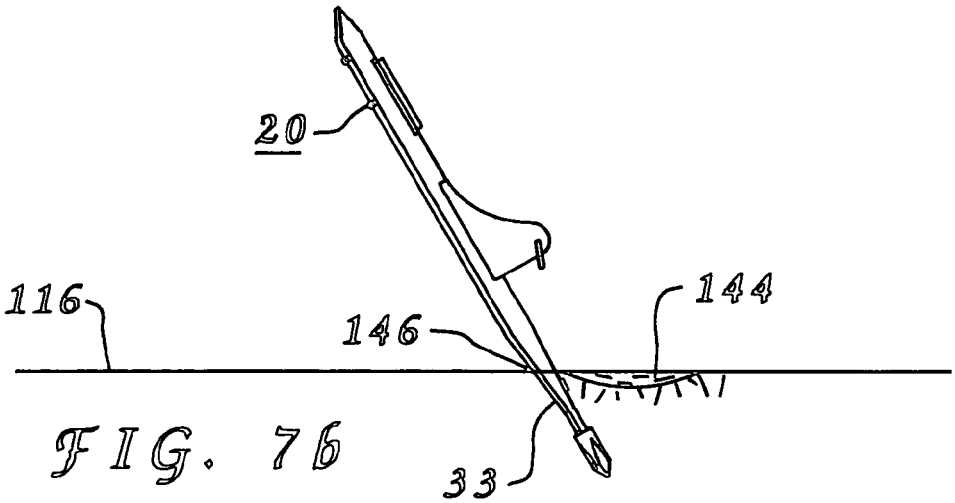
Figure 7C:
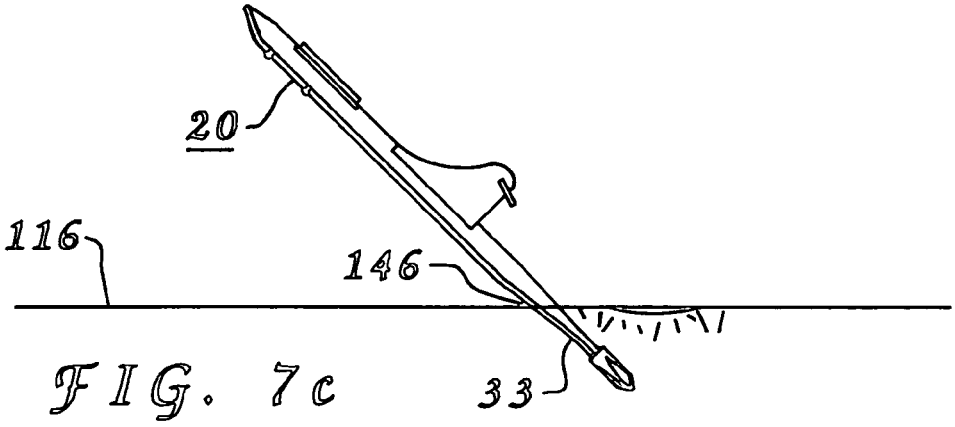
Figure 8A:
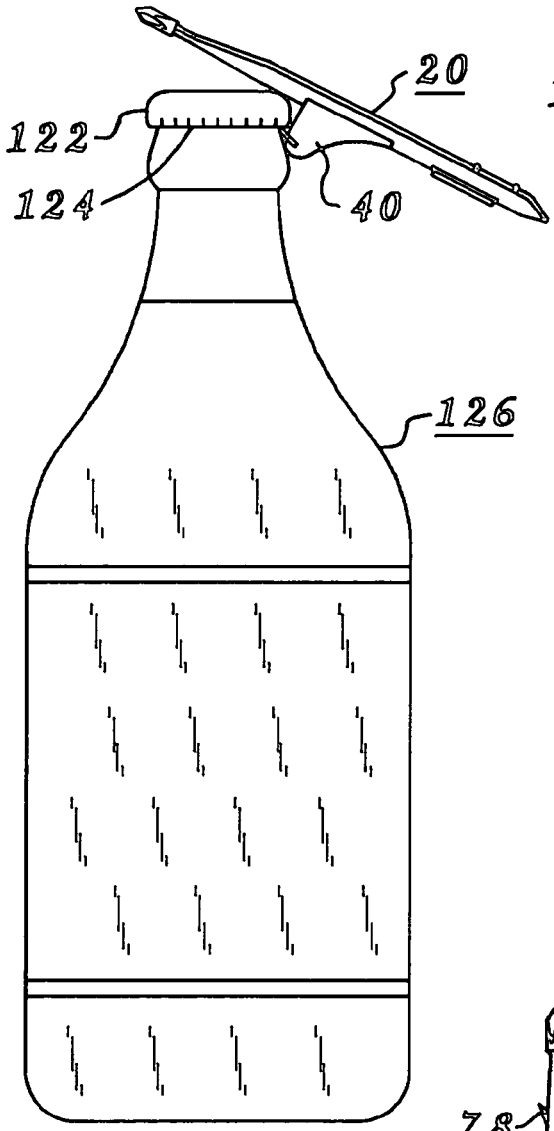
FIG. 8*a* and FIG. 8*b* are side elevational views of the multiple purpose golf tool performing a bottle opening procedure.
Figure 8B:
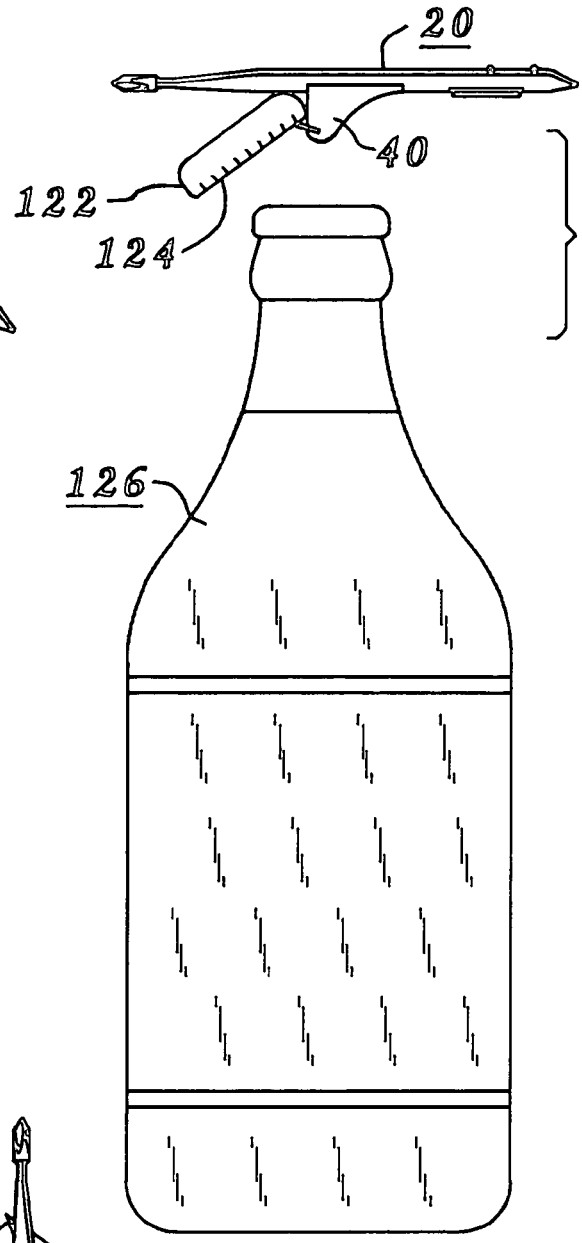

Referring now to FIG. 7*a* through FIG. 7*c*, turf repair portion 33 of multiple purpose golf tool 20 provides for multiple purpose golf tool 20 to be manually manipulated to insert turf repair portion 33 into turf 116 then manually manipulated to release a compression 144 of turf 116 about a point of insertion 146.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A multiple purpose golf tool to provide for performance of multiple useful functions during play of the game of golf, the multiple purpose golf tool comprising:

a) a body portion having features to perform at least a first useful function during play of the game of golf, the body portion formed from a first material, the body portion having a turf repair portion to perform the first useful function associated with the play of the game of golf being release of compression of turf associated with an impact from a golf ball, the turf repair portion for insertion into the turf at a point of insertion and then manual manipulation of the multiple purpose golf tool to displace the turf repair portion while inserted in the turf to release the compression of the turf about the point of insertion of the turf repair portion and wherein the turf repair portion further comprises a first extension and a second extension;

b) an insert portion attachable to the body portion, the insert portion formed from a second material, the insert portion to perform a second useful function during play of the game of golf and wherein the insert portion further comprises an opposing surface relative to the insertion portion with a passageway therebetween, the passageway having an end and wherein the cutting edge is positioned at the end of the passageway and wherein the second useful function performed by the insert portion further comprises a structural configuration to perform a cutting action on a grip wrapping material of a golf club and having an insertion portion for sliding between the grip wrapping material of the golf club and a handle of the golf club and a cutting edge positioned adjacent the insertion portion to perform the cutting action on the grip wrapping material and wherein the insert portion further comprises pivotal means of the insertion portion and the cutting edge relative to the body portion wherein at least a portion of the insert portion having the insertion portion and the cutting edge are displaceable between a stored orientation and a usage orientation.

2. The multiple purpose golf tool defined in claim 1 wherein the insert portion is removable by the user and replaceable by the user relative to the body portion.

3. The multiple purpose golf tool defined in claim 1 wherein the second useful function performed by the insert portion further comprises a structural configuration positioned between the first extension and the second extension of the turf repair portion of the body portion and having a sharp edge capable to performing a sharpening procedure.

4. The multiple purpose golf tool defined in claim 1 wherein the insert portion further comprises a pocket portion and a pivotal displaceable portion, the pocket portion having opposing protecting walls with a pocket positioned therebetween and wherein the insertion portion and the cutting edge of the pivotal displaceable portion are stored within the pocket when in the stored orientation.

5. The multiple purpose golf tool defined in claim 1 wherein the insert portion further comprises a seating surface and wherein the body portion further has an insert portion placement location and having a recessed lip extending about the insert portion placement location of the body portion to contact the seating surface of the insert portion.

6. The multiple purpose golf tool defined in claim 5 wherein the insert portion further comprises an aperture at least partially penetrating the insert portion and wherein the recessed lip of the body portion further comprises an aperture at least partially penetrating the recessed lip and wherein the aperture of the insert portion and the aperture of the recessed lip of the body portion cooperate to receive a threaded screw for retention of the insert portion relative to the body portion.

7. The multiple purpose golf tool defined in claim 1 wherein the body portion further comprises an insert portion placement location and wherein the insert portion placement location of the body portion has a seating surface and wherein the insert portion further has a recessed lip to contact the seating surface of the insert portion placement location of the body portion.

8. The multiple purpose golf tool defined in claim 7 wherein the body portion further comprises an aperture at least partially penetrating the insert portion in close proximity to the insert portion placement location and wherein the recessed lip of the insert portion further comprises an aperture at least partially penetrating the recessed lip and wherein the aperture of the body portion and the aperture of the recessed lip of the insert portion cooperate to receive a threaded screw for retention of the insert portion relative to the body portion.

9. A multiple purpose golf tool to provide for performance of at least four useful functions during play of the game of golf, the multiple purpose golf tool comprising:

a) a body portion having features to perform at least two unique useful function during play of the game of golf, the body portion formed from a first material, the body portion having a turf repair portion to perform one of the unique useful functions associated with the play of the game of golf being release of compression of turf associated with an impact from a golf ball, the turf repair portion for insertion into the turf at a point of insertion and then manual manipulation of the multiple purpose golf tool to displace the turf repair portion while inserted in the turf to release the compression of the turf about the point of insertion of the turf repair portion and wherein the turf repair portion further comprises a first extension and a second extension;

b) a first insert portion attachable to the body portion, the first insert portion to perform a unique useful function during play of the game of golf, the first insert portion formed of a different material compared to the material of the body portion;

c) a second insert portion attachable to the body portion, the second insert portion to perform a unique useful function during play of the game of golf, the second insert portion formed of a different material compared to the material of the body portion;

and wherein the unique useful function performed by one of the insert portions further comprises a structural configuration positioned between the first extensions and the second extension of the turf repair portion of the body portion and wherein the structural configuration has a sharp edge capable of performing a sharpening procedure.

10. The multiple purpose golf tool defined in claim 9 wherein the first insert portion and the second insert portion are each removable by the user and replaceable by the user relative to the body portion.

11. The multiple purpose golf tool defined in claim 9 wherein the unique useful function performed by one of the insert portions further comprises a structural configuration having ridges to provide for a cleaning procedure on grooves positioned on a face of a golf club.

12. The multiple purpose golf tool defined in claim 9 wherein the unique useful function performed by one of the insert portions further comprises a structural configuration to perform a cutting action on a grip wrapping material of a golf club and having an insertion portion for sliding between the grip wrapping material of the golf club and a handle of the golf club and a cutting edge positioned adjacent the insertion portion to perform the cutting action on the grip wrapping material.

13. The multiple purpose golf tool defined in claim 12 wherein the structural configuration of the respective insert portion further comprises pivotal means of the insertion portion and the cutting edge relative to the body portion wherein at least a portion of the first insert portion having the insertion portion and the cutting edge are displaceable between a stored orientation and a usage orientation.

14. The multiple purpose golf tool defined in claim 9 wherein a structural configuration of the body portion performs a unique useful function associated with the play of the game of golf is positioned on at a distal end of the first extension of the turf repair portion and wherein the unique useful function of the respective structural configuration is applying a rotational pressure to a slot of a slotted head screw utilizing a slotted head screwdriver configuration at the distal end of the first extension of the turf repair portion.

15. A multiple purpose golf tool to provide for performance of at least four useful functions during play of the game of golf, the multiple purpose golf tool comprising:

a) a body portion having features to perform at least two unique useful function during play of the game of golf, the body portion formed from a first material, the body portion having a turf repair portion to perform one of the unique useful functions associated with the play of the game of golf being release of compression of turf associated with an impact from a golf ball, the turf repair portion for insertion into the turf at a point of insertion and then manual manipulation of the multiple purpose golf tool to displace the turf repair portion while inserted in the turf to release the compression of the turf about the point of insertion of the turf repair portion and wherein the turf repair portion further comprises a first extension and a second extension;

b) a first insert portion attachable to the body portion, the first insert portion to perform a unique useful function during play of the game of golf, the first insert portion formed of a different material compared to the material of the body portion;

c) a second insert portion attachable to the body portion, the second insert portion to perform a unique useful function during play of the game of golf, the second insert portion formed of a different material compared to the material of the body portion;

and wherein a structural configuration of the body portion performs a unique useful function associated with the play of the game of golf is positioned at a distal end of the second extension of the turf repair portion and wherein the second useful function of the respective structural configuration is applying a rotational pressure to a phillips slot of a phillips slotted head screw utilizing a phillips slotted head screwdriver configuration at the distal end of the second extension of the turf repair portion.

* * * * *